United States Patent [19]

Stuntz et al.

[11] Patent Number: 4,504,379

[45] Date of Patent: Mar. 12, 1985

[54] PASSIVATION OF METAL CONTAMINANTS IN CAT CRACKING

[75] Inventors: Gordon F. Stuntz; Robert C. Schucker, both of Baton Rouge, La.

[73] Assignee: Exxon Research and Engineering Co., Florham Park, N.J.

[21] Appl. No.: 525,787

[22] Filed: Aug. 23, 1983

[51] Int. Cl.[3] ..... C10G 11/00

[52] U.S. Cl. ..... 208/113; 208/120; 502/34; 502/521

[58] Field of Search ..... 502/34, 521; 208/113, 208/120

[56] References Cited

U.S. PATENT DOCUMENTS

| | | | |
|---|---|---|---|
| 3,150,942 | 9/1964 | Vasan | 55/31 |
| 3,254,020 | 5/1966 | Frayer | 208/89 |
| 3,355,509 | 11/1967 | Carter et al. | 260/677 |
| 3,412,013 | 11/1968 | Bowles | 208/120 |
| 3,437,713 | 4/1969 | Long | 260/681.5 |
| 3,514,488 | 5/1970 | Uebele et al. | 260/677 |
| 4,064,036 | 12/1977 | Clark | 208/46 |
| 4,083,807 | 4/1978 | McKinney | 208/120 |
| 4,183,803 | 1/1980 | McKay | 208/120 |
| 4,216,120 | 8/1980 | Nielsen | 502/162 |
| 4,268,416 | 5/1981 | Stein et al. | 252/416 |
| 4,280,895 | 7/1981 | Stuntz et al. | 208/113 |
| 4,280,896 | 7/1981 | Bearden et al. | 208/113 |
| 4,280,898 | 7/1981 | Tatterson et al. | 208/119 |
| 4,298,459 | 11/1981 | Tatterson et al. | 208/120 |
| 4,361,496 | 11/1982 | Castillo et al. | 252/416 |
| 4,364,848 | 12/1982 | Castillo et al. | 252/417 |
| 4,370,220 | 1/1983 | Bearden et al. | 208/108 |
| 4,372,840 | 2/1983 | Bearden et al. | 208/113 |
| 4,372,841 | 2/1983 | Stuntz et al. | 208/113 |
| 4,382,015 | 5/1983 | Castillo et al. | 252/417 |
| 4,404,090 | 9/1983 | Castillo et al. | 208/120 |
| 4,409,093 | 10/1983 | Bearden, Jr. | 208/108 |

FOREIGN PATENT DOCUMENTS

| | | |
|---|---|---|
| 52356 | 5/1982 | European Pat. Off. . |
| WO82/04063 | 11/1982 | PCT Int'l Appl. . |
| 1570682 | 7/1980 | United Kingdom . |

OTHER PUBLICATIONS

Carter, et al., in Journal of Physical Chemistry, vol. 70, No. 4, (1966), pp. 1126–1136.

"Copper(I)–Ethylene Complexes in Y Zeolite" by Yu-n-Yang Huang et al., J.C.S. Chem. Comm., 1974, pp. 584–585.

*Primary Examiner*—Delbert E. Gantz

*Assistant Examiner*—Cynthia A. Prezlock

*Attorney, Agent, or Firm*—Edward H. Mazer; Robert J. North

[57] ABSTRACT

A method for passivating metal contaminants present in a hydrocarbon feedstock which become deposited on cracking catalyst is described. The method is directed at passing the cracking catalyst through a passivation zone having a reducing atmosphere maintained at an elevated temperature. The reducing atmosphere comprises a process reducing gas stream which has been passed through a guard bed adapted to selectively remove an unsaturated hydrocarbon prior to the process reducing gas being added to the passivation zone.

25 Claims, 1 Drawing Figure

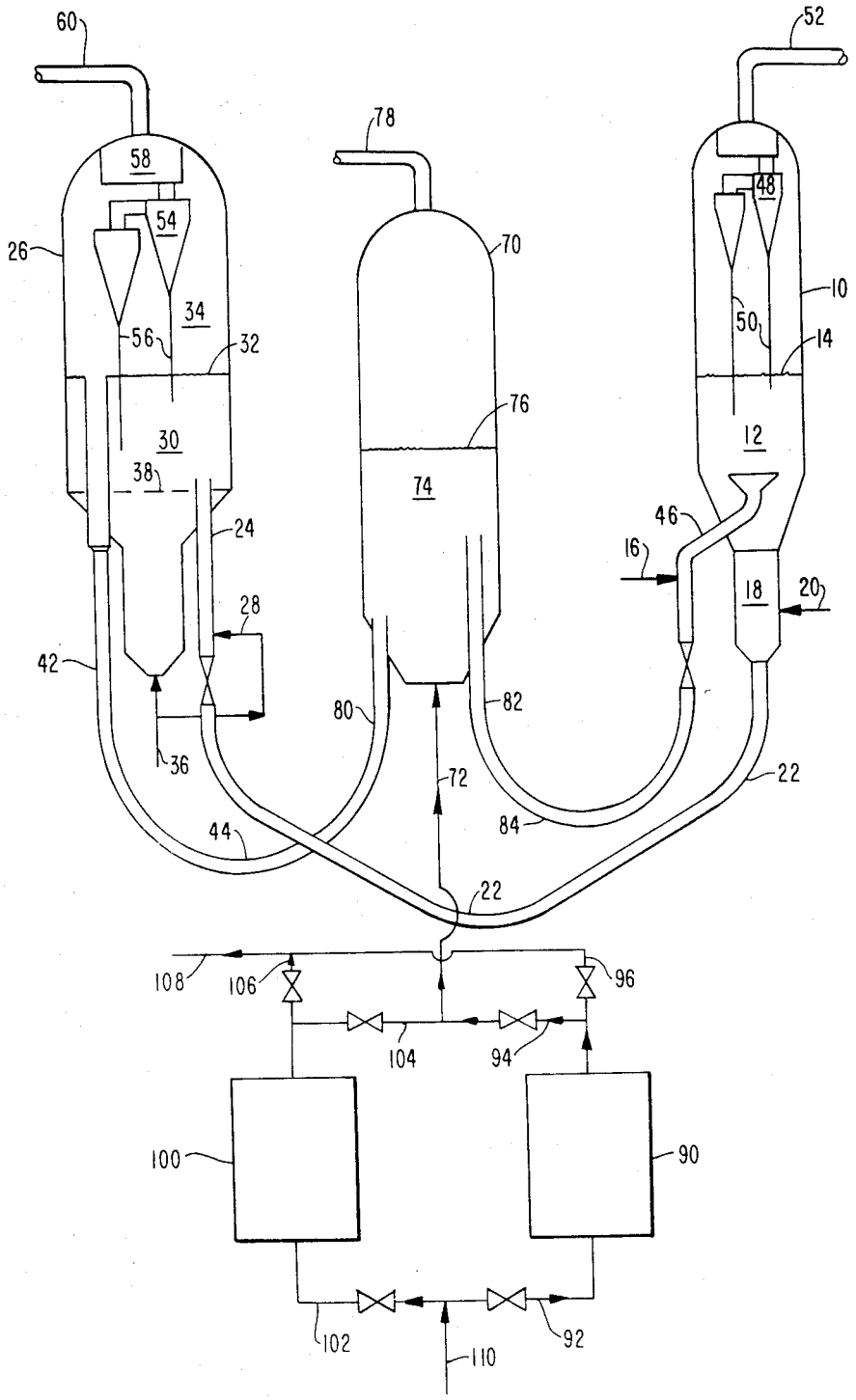
60
52
78
58
48
54
26
70
10
34
50
56
32
14
76
30
12
38
74
46
24
16
18
20
28
42
80
82
36
72
22
84
44
22
108
106
96
104
94
100
90
102
92
110

PASSIVATION OF METAL CONTAMINANTS IN CAT CRACKING

BACKGROUND OF THE INVENTION

This invention is directed at a method for removing unsaturated hydrocarbon compounds from a process reducing gas stream utilized for metals passivation. More specifically, the present invention is directed at a method for removing olefins from a refinery process reducing gas stream utilized for passivating metals contaminated cracking catalyst.

In the catalytic cracking of hydrocarbon feedstocks, particularly heavy feedstocks, nickel, vanadium and/or iron present in the feedstocks become deposited on the cracking catalyst promoting excessive hydrogen and coke makes. These metal contaminants are not removed by conventional catalyst regeneration operations, which convert coke deposits on the catalyst to CO and $CO_2$.

As used hereinafter, the term "passivation" is defined as a method for decreasing the detrimental catalytic effects of metal contaminants such as nickel, vanadium and/or iron which become deposited on the cracking catalyst. Several patents disclose the use of a reducing atmosphere to passivate cracking catalyst. U.S. Pat. Nos. 4,280,895 and 4,280,896 disclose that cracking catalyst can be passivated by passing the catalyst through a passivation zone having a reducing atmosphere maintained at an elevated temperature for a period of time ranging from 30 seconds to 30 minutes, typically from about 2 to 5 minutes. These patents disclose that process gas streams containing $H_2$ and/or CO, such as cat cracker tail gas, catalytic reformer off-gas, spent hydrogen streams from catalytic hydroprocessing, synthesis gas and flue gases can be utilized.

U.S. Pat. Nos. 4,298,459 and 4,280,898 describe processes for cracking a metals-containing feedstock where the used cracking catalyst is subjected to alternate exposures of up to 30 minutes of an oxidizing zone and a reducing zone maintained at an elevated temperature to reduce the hydrogen and coke makes.

U.S. Pat. No. 4,268,416 also describes a method for passivating cracking catalyst in which metal contaminated cracking catalyst is contacted with a reducing gas at elevated temperatures to passivate the catalyst.

U.S. Pat. Nos. 4,361,496; and 4,364,848; and 4,382,015 describe metals passivation processes in which the metals contaminated catalyst is contacted with hydrogen and with a $C_1$–$C_3$ hydrocarbon at an elevated temperature to reduce the metal contaminants and to selectively coat the contaminant sites with a layer of carbon.

European Patent Publication No. 52,356 also discloses that metal contaminants can be passivated utilizing a reducing atmosphere at an elevated temperature. This publication discloses that the reducing gas source can include regenerator off gases or light gases from the catalytic cracker.

International Patent Application No. WO82/04063 discloses the contacting of a regenerated catalyst with a reducing gas at elevated temperature to reduce oxidized nickel deposits on the cracking catalyst.

It also has been known to remove olefins, such as ethylene from hydrocarbon gas streams. In J.C.S. Chem. Comm. (1974) pages 584–585, Huang and Mainwaring disclose that ethylene formed a stable complex with copper (I) in a Type Y zeolite. In the Journal of Physical Chemistry, Vol. 70, No. 4, (1966) at pages 1126–1136, Carter et al also disclose that ethylene could be adsorbed on zeolites. U.S. Pat. No. 3,355,509 discloses the separation of olefins, particularly normal olefins, from other straight chain hydrocarbons utilizing cadmium or strontium substituted type X or type Y sieves. U.S. Pat. No. 3,150,942 discloses the use of molecular sieves to purify hydrogen.

Several U.S. patents disclose that copper containing compounds can be used to selectively remove an olefin from a gas stream. U.S. Pat. No. 3,437,713 discloses the use of cuprous halide complexes for selective olefinic separations including the selective separation of ethylene from a steam cracking stream and from ethane. U.S. Pat. No. 3,514,488 discloses a method for adsorption and desorption of olefins from saturated hydrocarbons utilizing copper complexes.

It has been found that the presence of unsaturated compounds, particularly olefinic compounds such as ethylene, in refinery gas streams contributes to excessive coke formation on the cracking catalyst. Excessive coke formation on the cracking catalyst is not desirable for several reasons. The presence of coke on cracking catalyst decreases the activity of the catalyst. Excess coke on the catalyst may also result in excess heat being liberated from the catalyst when the catalyst subsequently is regenerated. In some facilities where the regeneration zone capacity is limited by the air blower capacity, excess coke on the catalyst may require a reduction in the feed rate to the reaction zone.

Accordingly, it is desirable to provide a process which is capable of passivating metal contaminants on cracking catalyst utilizing available reducing gas sources without excess coke formation.

It also is desirable to provide a process for passivating cracking catalyst which is capable of utilizing reducing gas generated by the cracking zone.

It also is desirable to provide a process which is reliable and has a relatively low operating cost for selectively removing undesired compounds from reducing gas.

It also is desirable to provide a process which permits the separation and recovery of unsaturates from a process gas stream.

The subject invention is directed at a method for purifying commercially available reducing gas streams prior to their introduction into a passivation zone to passivate metal contaminants deposited on cracking catalyst. The present invention removes the unsaturated compounds, such as olefins, from the reducing gas prior to the addition of the reducing gas to the passivation zone. In a preferred embodiment the reducing gas is passed through a bed of zeolite adsorbent to remove the olefin. Metals exchanged zeolites are preferred, with a Cu(I)Y zeolite being especially preferred.

SUMMARY OF THE INVENTION

The present invention is directed at a method for reducing the detrimental effects of metal contaminants on cracking catalyst where the feedstock contains a metal contaminant selected from the group consisting of nickel, vanadium, iron and mixtures thereof. The method comprises:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst through a passivation zone maintained under reducing conditions at an elevated temperature prior to the catalyst being returned to the reaction zone, the improvement wherein the reducing conditions are maintained in the passivation zone by passing process reducing gas through a guard zone adapted to remove unsaturated compounds from the reducing gas prior to the reducing gas entering the passivation zone.

In a preferred embodiment the guard zone comprises a zeolite. The zeolite preferably is metal exchanged Y type zeolite, and most preferably is a Cu(I) Y type zeolite. The passivation zone preferably is disposed downstream of the regeneration zone, regenerated catalyst passing through the passivation zone prior to being returned to the reaction zone. The process reducing gas preferably comprises a petroleum refinery process reducing gas.

BRIEF DESCRIPTION OF THE DRAWING

The FIGURE is a flow diagram of a fluidized cracking unit employing the subject invention.

DETAILED DESCRIPTION OF THE INVENTION

Referring to the FIGURE, one method for practicing the subject invention is shown. In this drawing pipes, valves, instrumentation, etc. not essential to an understanding of the invention have been deleted for simplicity. Reaction or cracking zone 10 is shown containing a fluidized catalyst bed 12 having a level at 14 in which a hydrocarbon feedstock is introduced into the fluidized bed through line 16 for catalytic cracking. The hydrocarbon feedstock may comprise naphthas, light gas oils, heavy gas oils, residual fractions, reduced crude oils, cycle oils derived from any of these, as well as suitable fractions derived from shale oil, kerogen, tar sands, bitumen processing, synthetic oils, coal hydrogenation, and the like. Such feedstocks may be employed singly, separately in parallel reaction zones, or in any desired combination. Typically, these feedstocks will contain metal contaminants such as nickel, vanadium and/or iron. Heavy feedstocks typically contain relatively high concentrations of vanadium and/or nickel. Hydrocarbon gas and vapors passing through fluidized bed 12 maintain the bed in a dense turbulent fluidized condition. Typically the temperature in reaction zone 10 will range between about 450° and about 600° C., while the pressure will range between about 0 and about 50 psig.

In reaction zone 10, the cracking catalyst becomes spent during contact with the hydrocarbon feedstock due to the deposition of coke thereon. Thus, the terms "spent" or "coke-contaminated" catalyst as used herein generally refer to catalyst which has passed through a reaction zone and which contains a sufficient quantity of coke thereon to cause activity loss, thereby requiring regeneration. Generally, the coke content of spent catalyst can vary anywhere from about 0.5 to about 5 wt.% or more. Typically, spent catalyst coke contents vary from about 0.5 to about 1.5 wt.%.

Prior to actual regeneration, the spent catalyst is usually passed from reaction zone 10 into a stripping zone 18 and contacted therein with a stripping gas, which is introduced into the lower portion of zone 18 via line 20. The stripping gas, which is usually introduced at a pressure of from about 10 to 50 psig, serves to remove most of the volatile hydrocarbons from the spent catalyst. A preferred stripping gas is steam, although nitrogen, other inert gases or flue gas may be employed. Normally, the stripping zone is maintained at essentially the same temperature as the reaction zone, i.e., from about 450° C. to about 600° C. Stripped spent catalyst from which most of the volatile hydrocarbons have been removed, is then passed from the bottom of stripping zone 18 through a first transfer zone, such as U-bend 22 and connecting vertical riser 24 which extends into the lower portion of a regeneration zone. Air is added to riser 24 via line 28 in an amount sufficient to reduce the density of the catalyst flowing therein, thus causing the catalyst to flow upwardly into regeneration zone 26 by simple hydraulic balance.

In the particular configuration shown, the regeneration zone is a separate vessel (arranged at approximately the same level as reaction zone 10) containing a dense phase catalyst bed 30 having a level indicated at 32, which is undergoing regeneration to burn-off coke deposits formed in the reaction zone during the cracking reaction, above which is a dilute catalyst phase 34. An oxygen-containing regeneration gas enters the lower portion of regeneration zone 26 via line 36 and passes up through a grid 38 in the dense phase catalyst bed 30, maintaining said bed in a turbulent fluidized condition similar to that present in reaction zone 10. Oxygen-containing regeneration gases which may be employed in the process of the present invention are those gases which contain molecular oxygen in admixture with a substantial portion of an inert diluent gas. Air is a particularly suitable regeneration gas. An additional gas which may be employed is air enriched with oxygen. Additionally, if desired, steam may be added to the dense phase bed along with the regeneration gas or separately therefrom to provide additional inert diluents and/or fluidization gas. Typically, the specific vapor velocity of the regeneration gas will be in the range of from about 0.8 to about 6.0 feet/sec., preferably from about 1.5 to about 4 feet/sec. The temperature in regeneration zone 26 will vary with location within the zone and typically will range between about 600° and about 800° C.

In regeneration zone 26, flue gases formed during regeneration of the spent catalyst pass from the dense catalyst bed 30 into the dilute catalyst phase 34 along with entrained catalyst particles. The catalyst particles are separated from the flue gas by a suitable gas-solid separation means 54 and are returned to the dense phase catalyst bed 30 via diplegs 56. The substantially catalyst-free flue gas then passes into a plenum chamber 58 prior to discharge from regeneration zone 26 through line 60. Regeneration zone 26 may be operated in a net oxidizing mode, where sufficient oxygen is added to completely combust the coke on the catalyst to $CO_2$, or the regeneration zone may be operated in a net reducing mode, where insufficient oxygen is added to completely combust the coke. In the present case, where a passivation zone 70 is employed, operation of regeneration zone 26 in the net reducing mode is preferred.

Regenerated catalyst exiting from regeneration zone 26 preferably has had a substantial portion of the coke removed. Typically, the carbon content of the regenerated catalyst will range from about 0.01 to about 0.2 wt.%, preferably from about 0.01 to about 0.1 wt.%. The regenerated catalyst from the dense phase catalyst bed 30 in regeneration zone 26 flows downwardly through standpipe 42, U-bend 44 and riser 80 into passivation zone or reduction zone 70 containing a catalyst bed 74 having a level 76.

Passivation zone 70 may be any vessel providing suitable contacting of the catalyst with a reducing environment at elevated temperatures. The shape of passivation zone 70 is not critical. In the embodiment shown, passivation zone 70 comprises a treater vessel having a shape generally similar to that of regeneration zone 26, with the reducing environment maintained and catalyst fluidized by a reducing agent, such as a process reducing gas stream, entering through line 72 and exiting through line 78. The volume of dense phase 74 having a level at 76 is dependent on the required residence time. The residence time of the catalyst in passivation zone 70 is not critical as long as it is sufficient to effect the passivation. The residence time will range from about 30 sec. to about 30 min., typically from about 2 to 5 minutes. The pressure in this zone is not critical and generally will be a function of the location of passivation zone 70 in the system and the pressure in the adjacent regeneration and reaction zones. In the embodiment shown, the pressure in zone 70 will be maintained in the range of about 5 to 50 psia, although the reduction zone preferably should be designed to withstand pressures of 100 psia. The temperature in passivation zone 70 should be above about 500° C. preferably above 600° C., but below the temperature at which the catalyst sinters or degrades. A preferred temperature range is about 600°–850° C., with the more preferred temperature range being 650°–750° C.

Passivation zone 70 can be constructed of any chemically resistant material sufficiently able to withstand the relatively high temperatures involved and the high attrition conditions which are inherent in systems wherein fluidized catalyst is transported. Specially, metals are contemplated which may or may not be lined. More specifically, ceramic liners are contemplated within any and all portions of the reduction zone together with alloy use and structural designs in order to withstand the maximum contemplated operating temperatures.

Guard zones or beds 90 and 100, communicating with passivation zone 70, are adapted to remove unsaturates from the process reducing gas stream prior to its addition to the passivation zone. Since the ability of guard beds, such as guard beds 90 and 100, to remove unsaturated compounds from the process reducing gas stream will decline in time as these compounds build up on the adsorbent, periodically the unsaturates must be removed from the adsorbent. To permit a continuous removal of the unsaturates from the process gas, a plurality of guard beds typically would be installed in a parallel type arrangement, such that one or more beds would be in service while one or more beds would be in the regeneration cycle. In the embodiment shown, guard bed 90 is in the service cycle while guard bed 100 is in the regeneration cycle with recovery of the desorbed materials.

A refinery process gas stream is shown passing through lines 110 and 92 into guard bed 90 having a zeolite adsorbent therein, more particularly described hereinafter. Guard bed 90 selectively removes unsaturated hydrocarbons from the process gas stream. The process gas stream, having a reduced unsaturate content, exits from guard bed 90 through lines 94 and 72 for entry into passivation zone 70. The degree to which the unsaturates are removed in guard bed 70 will depend on many variables including the degree to which the process gas stream is unsaturated, the residence time in guard bed 90, and the particular adsorbent utilized. The degree to which the process gas stream is unsaturated will be dependent primarily on the gas source. Preferred sources of the process gas stream are catalytic cracker tail gas streams, reformer tail gas streams, spent hydrogen streams from catalytic hydroprocessing synthesis gas, steam cracker gas, flue gas, and mixtures thereof, where the unsaturates content typically will range between about 0.1 and about 50 wt.%. A particularly preferred source of the process reducing gas is cat cracker tail gas.

The method by which guard bed 100 is desorbed is not critical. Typical methods for desorption comprise heating the bed and/or reducing the pressure on the bed. Reducing the bed pressure is particularly attractive where guard bed 100 had been operating under a positive pressure in the service mode. In the embodiment shown where guard bed 100 is being desorbed, the unsaturates removed from the bed pass through lines 106 and 108 for recovery (not shown).

Although guard beds 90 and 100 are described herein as having regenerable adsorbent therein, it is clear that other methods of selectively removing the unsaturates from the process gas stream may be utilized in the guard beds. Regenerable adsorbents are preferred, since this permits reuse of the adsorbent and ultimate recovery of the unsaturates. However, any adsorbent may be used in guard beds 90 and 100 which effectively and selectively removes unsaturates from the particular process gas stream utilized. Typical adsorbents which may be useful are zeolites, with the Type X and Type Y zeolites preferred.

Type X and Type Y zeolites are well-known in the art. These zeolites comprise crystalline aluminosilicates and have substantially uniform pore openings ranging between about 6 and about 8 Angstroms. Commercially these are available from several manufacturers. Type X zeolite differs from Type Y zeolite in that Type Y zeolite usually has silica to alumina ratios of greater than 1.5, whereas Type X zeolite usually has ratios of about 1 to about 1.5. Moreover the unit cell constants for Type Y and Type X zeolites are 24.85–24.61 Angstroms and 25.02–24.86 Angstroms, respectively. It is preferred that a transition metal be ion exchanged into the catalyst to improve its ability to adsorb unsaturates. Among the preferred metals are copper, scandium, titanium, vanadium, chromium, manganese, iron, silver, nickel and cobalt. A particularly preferred metal is copper. The most preferred adsorbent is Cu(I)Y.

The temperature of guard bed 90 in the service cycle removing unsaturates is not critical and may range between about 0° C. and about 100° C., preferably between about 25° C. and about 50° C. Similarly, the pressure in guard bed 90 is not critical and may range between about 0 PSIG and about 500 PSIG, preferably between about 25 PSIG and about 100 PSIG. The temperature of guard bed 100 in the regeneration or desorption cycle may range between about 100° C. and about 300° C., preferably between about 200° C. and about 250° C. The pressure in guard bed 100 during regeneration may range between about 0 PSIG and about 100 PSIG, preferably between about 0 PSIG and about 25 PSIG.

It can be seen that, when unsaturates build-up on guard bed 90 and guard bed 100 has been regenerated, guard bed 90 can be switched to the regeneration cycle and guard bed 100 put in the service cycle. Refinery process reducing gas then would flow through lines 110 and 102 into bed 100. Process reducing gas having a reduced unsaturates content would exit guard bed 100 through lines 104 and 72 into passivation zone 70. Unsaturates removed from guard bed 90 would pass through lines 96 and 108 for recovery (not shown).

The size of guard beds 90 and 100, will be dependent in part on the desired degree of unsaturates removal, the unsaturates content in the process reducing gas, the adsorbent utilized, the desired operating period between regenerations, the process reducing gas consumption rate, and the total number of guard beds. While only two guard beds have been shown, it is clear that a larger number of beds could be used.

In the initial series of tests described hereinafter, a commercially available silica-alumina cracking catalyst, CBZ-1, manufactured by the Davison Chemical Division, W. R. Grace & Co. was contaminated with 0.48 wt.% nickel and 0.61 wt.% vanadium. In each test utilizing passivation zone 70, the catalyst was maintained in the indicated passivation zone reducing atmosphere at 750° C. for 20 minutes. The coke formed on the catalyst in passivation zone 70 by the process reducing gas was determined by catalyst sampling prior to the catalyst being used for catalytic cracking. A typical cat cracking feed comprising vacuum gas oil, subsequently was passed over each of the catalyst samples maintained at 500° C. in a micro catalytic cracking (MCC) type unit.

Initial tests were conducted to determine base levels for hydrogen and coke makes, or yields, without passivation, and with passivation using research grade hydrogen and also using a typical $C_2^-$ cat cracker tail gas. The composition of these reducing streams is presented in Table I. The coke make attributable to the passivation treatment, and the hydrogen and coke makes attributable to the cracking process are presented in Table II.

EXAMPLE I

An olefin-free tail gas was prepared having the composition indicated in Table I. This olefin-free tail gas was used to passivate the cracking catalyst, afterwhich the catalyst was contacted with feed as before. The coke make attributable to the passivation treatment, and the hydrogen and coke makes resulting from contacting the feed are presented in Table II.

TABLE I

| Reducing Gas Utilized | Composition (wt. %) $H_2$ | $CH_4$ | $C_2H_4$ | $C_2H_6$ | $C_3H_8$ |
|---|---|---|---|---|---|
| Hydrogen | 100 | — | — | — | — |
| $C_2^-$ Cat Cracker Tail Gas | 50 | 25 | 12.5 | 12.5 | — |
| Olefin Free Tail Gas | 80 | 10 | — | 6 | 4 |

TABLE II

| Passivation Treatment | Wt. % Coke on Catalyst from Passivation | MCC Yields, wt. % $H_2$ | Coke |
|---|---|---|---|
| None | — | 1.23 | 11.69 |
| Hydrogen | — | 0.88 | 6.88 |
| $C_2^-$ Cat Cracker Tail Gas | 1.24 | 0.92 | 6.96* |
| Olefin-free Tail Gas | 0.04 | 0.91 | 7.64* |

*Coke attributable only to cracking process

A second series of tests was conducted utilizing the same catalyst. In this series of tests, the catalyst was again contaminated with 0.48 wt.% nickel and 0.61 wt.% vanadium. In each test utilizing a passivation zone, the catalyst was maintained in the particular reducing atmosphere at the indicated temperature for 20 minutes. Coke formed in the passivation zone by the particular reducing gas again was determined by catalyst sampling prior to the catalyst being used for cracking. The feed used for the cracking tests was the same as for the first series of tests. Cracking tests were conducted at 500° C. in an MCC type unit. Initial tests again were conducted to determine base levels for hydrogen and coke makes without passivation and with passivation using research grade hydrogen and also using a typical $C_2^-$ cat cracker tail gas having the same composition as that shown in Table I. The coke makes attributable to each passivation treatment as well as the hydrogen and coke makes attributable to the cracking process are presented in Table III.

EXAMPLE II

An olefin-free reformer gas, comprising 75 wt.% $H_2$ and 25 wt.% $CH_4$ was used to passivate separate cracking catalyst samples at 650° C. and at 750° C. for 20 minutes. After passivation, the catalyst was utilized to crack the feedstock. The coke make attributable to the passivation treatment as well as the hydrogen and coke makes from the feed also are presented in Table III.

The data in Tables II and III illustrate that olefin-free reducing gas passivates metals contaminated cracking catalyst without producing as much coke as olefin-containing reducing gases. A comparison of Tables II and III also shows that, at 650° C. with passivation the coke formation attributable to the olefins is not as significant as it is with passivation at 750° C. However, reduction zone passivation is more effective in reducing the hydrogen and coke makes at 750° C. than it is at 650° C.

TABLE III

| Passivation Treatment | Passivation Temperature | Wt. % Coke on Catalyst from Passivation | MCC Yields, Wt. % $H_2$ | Coke |
|---|---|---|---|---|
| None | — | — | 1.23 | 11.69 |
| Hydrogen | 750° C. | — | 0.88 | 6.88 |
| $C_2^-$ Cat Cracker Tail Gas | 750° C. | 1.24 | 0.92 | 6.96* |
| Reformer Gas | 750° C. | 0.09 | 0.77 | 6.35* |
| Hydrogen | 650° C. | — | 1.12 | 8.81 |
| $C_2^-$ Cat Cracker Tail Gas | 650° C. | 0.13 | 1.06 | 8.82* |
| Reformer Gas | 650° C. | 0.11 | 1.00 | 8.04* |

*Coke attributable only to cracking process

Examples III, IV and V demonstrate the ability of Cu(I)Y zeolite to adsorb and desorb unsaturated hydrocarbons.

EXAMPLE III

A commercially available NaY zeolite, LZ-Y82, manufactured by the Linde Division of Union Carbide Corporation, was ion-exchanged using an aqueous solution of $Cu(NO_3)_2$. The zeolite was contacted with the aqueous $Cu(NO_3)_2$ solution at 70° C. to replace some of the sodium with Cu(II). After a period of time, the zeolite was filtered from the solution. This procedure for ion-exchanging zeolite is well-known by those skilled in the art and also is described in Union Carbide catalyst bulletin F-09A, the disclosure of which is incorporated herein by reference. After drying, the adsorbent was analyzed and found to contain 17.32 wt.% Cu(II). The Cu(II) subsequently was reduced to Cu(I) in flowing hydrogen at 200° C. A simulated cat cracker tail gas having the composition shown in Table IV was passed over approximately 95 grams of Cu(I)Y adsorbent at 28° C. at a rate of 30 cc/minute. A total of 15.2 liters of gas were passed through the adsorbent bed, and 13.1 liters were collected at the bed effluent. Essentially all the ethylene had been removed from the exit gas stream as shown by an analysis of the exit gas stream presented in Table IV.

TABLE IV

| Compound | Gas Composition, Volume % | |
|---|---|---|
| | Feed | Exit |
| $H_2$ | 35.6 | 52.0 |
| $CH_4$ | 33.0 | 37.4 |
| $C_2H_6$ | 16.5 | 10.5 |
| $C_2H_4$ | 13.6 | 0.0 |
| CO | 0.8 | 0.0 |

EXAMPLE IV

An experiment similar to that in Example II was carried out using the same Cu(I)Y adsorbent and the same feed gas composition, but with the feed gas flow rate increased to 130 cc/minute.

Approximately 16.3 liters of gas were passed over 95 grams of adsorbent at 28° C. Off-gas again was collected and analyzed. The results presented in Table V showed that the exit gas contained very little ethylene.

TABLE V

| Compound | Gas Composition, Volume % | |
|---|---|---|
| | Feed | Exit |
| $H_2$ | 35.6 | 44.5 |
| $CH_4$ | 33.0 | 40.8 |
| $C_2H_6$ | 16.5 | 14.7 |
| $C_2H_4$ | 13.6 | 0.2 |
| CO | 0.8 | 0.0 |

EXAMPLE V

The adsorption capacity of the Cu(I)Y used in Examples III and IV was determined by thermogravimetric analysis. A gas mixture of about 10 volume percent ethylene in helium was passed over a small sample of adsorbent at 25° C. until the weight of the adsorbent remained constant. This occurred after the weight of the adsorbent had increased by 7.4%. The flow of ethylene was discontinued and the temperature increased to 100° C. Desorption of the ethylene in the flowing helium was monitored by the weight loss of the adsorbent. The results showed that the ethylene was essentially completely desorbed. The cycle was repeated and showed similar results.

Thus, Examples III and IV demonstrate the effectiveness of Cu(I)Y in removing an unsaturated hydrocarbon from a typical cat cracker tail gas, while Example V demonstrates that unsaturated hydrocarbons can be effectively desorbed from the Cu(I)Y adsorbent.

Although the subject process has been described with reference to a specific embodiment, it will be understood that it is capable of further modification. Any variations, uses or adaptations of the invention following, in general, the principles of the invention are intended to be covered, including such departures from the present disclosure as come within known or customary practice in the art to which the invention pertains and as may be applied to the essential features hereinbefore set forth, and as fall within the scope of the invention.

What is claimed is:

1. In a cracking process, a method for reducing the adverse catalytic effects of metal contaminants selected from the group consisting of nickel, vanadium, iron and mixtures thereof present in a feedstock, said method comprising:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst through a passivation zone maintained under reducing conditions at an elevated temperature prior to the catalyst being returned to the reaction zone, the improvement wherein the reducing conditions are maintained in the passivation zone by passing process reducing gas through a guard zone adapted to remove an unsaturated hydrocarbon compound from the reducing gas prior to the reducing gas entering the passivation zone.

2. The method of claim 1 wherein the unsaturated hydrocarbon compound comprises an olefin.

3. The method of claim 2 wherein the olefin comprises ethylene.

4. The method of claim 2 wherein the guard zone comprises a zeolite.

5. The method of claim 4 wherein the zeolite is selected from the group consisting of Type X, Type Y and mixtures thereof.

6. The method of claim 5 wherein the zeolite comprises Type Y zeolite.

7. The method of claim 5 wherein the zeolite is metal exchanged.

8. The method of claim 7 wherein the metal exchanged into the zeolite is selected from the group consisting of copper, scandium, titanium, vanadium, chromium, manganese, iron, silver, nickel and cobalt.

9. The method of claim 8 wherein the zeolite comprises Cu(I)Y.

10. The method of claim 5 wherein the process reducing gas comprises a petroleum refinery process reducing gas.

11. The method of claim 10 wherein the petroleum refinery process reducing gas is selected from the group consisting of cat cracker tail gas, catalytic reformer tail-gas, spent hydrogen streams from catalytic hydroprocessing, synthesis gas, stream cracker gas, flue gas and mixtures thereof.

12. The method of claim 11 wherein the passivation zone is maintained at a temperature ranging between about 600° C. and about 850° C.

13. The method of claim 12 wherein the guard zone comprises a plurality of guard beds having regenerable adsorbent therein.

14. The method of claim 13 wherein each guard bed periodically is maintained in a service cycle removing ethylene from the process gas stream and periodically is maintained in a regeneration cycle desorbing the ethylene.

15. The method of claim 14 wherein the guard beds are regenerated by increasing the temperature of the guard beds.

16. The method of claim 14 wherein the guard beds are regenerated by decreasing the pressure of the guard beds.

17. The method of claim 14 wherein the desorbed ethylene is recovered.

18. A cracking process for decreasing the molecular weight of a hydrocarbon feedstock containing metal contaminant, said method comprising:

A. contacting the feedstock containing the metal contaminant with cracking catalyst in a reaction zone under cracking conditions to produce cracked product and coke, coke and metal contaminant being deposited on cracking catalyst;

B. passing coke and metal contaminated catalyst from the reaction zone to a regeneration zone maintained under regeneration conditions to remove coke from the catalyst; and, C. passing metal contaminated catalyst from the regneration zone through a passivation zone maintained under reducing conditions at an elevated temperature prior to the catalyst being returned to the reaction zone;

D. passing process reducing gas having an unsaturated hydrocarbon therein through a guard bed adapted to remove unsaturated hydrocarbon from the process reducing gas; and E. passing the process reducing gas having a reduced unsaturated hydrocarbon content from the guard bed to the passivation zone.

19. The process of claim 18 wherein the guard bed contains a regenerable adsorbent.

20. The process of claim 19 wherein the guard bed periodically is regenerated.

21. The process of claim 20 wherein the unsaturated hydrocarbon comprises an olefin.

22. The process of claim 21 wherein the olefin comprises ethylene.

23. The process of claim 22 wherein the regenerable catalyst comprises a zeolite selected from the group consisting of Type X zeolite, Type Y zeolite and mixtures thereof.

24. The process of claim 23 wherein the zeolite is metal exchanged.

25. The process of claim 24 wherein the zeolite comprises Cu(I) Y zeolite.

* * * * *